United States Patent [19]

Stanback et al.

[11] 3,973,823

[45] Aug. 10, 1976

[54] ELECTRICAL TERMINAL CONNECTOR

[75] Inventors: Harris I. Stanback, Lexington, Ky.; Paul K. Campbell, Birmingham, Ala.

[73] Assignee: Square D Company, Park Ridge, Ill.

[22] Filed: Sept. 6, 1974

[21] Appl. No.: 503,888

[52] U.S. Cl. ..... 339/276 T
[51] Int. Cl.[2] ..... H01R 5/10
[58] Field of Search ..... 339/275 T, 276 T, 277 R

[56] References Cited

UNITED STATES PATENTS

| | | | |
|---|---|---|---|
| 533,910 | 2/1895 | Metzger | 339/276 T |
| 1,227,726 | 5/1917 | Woodhead | 339/276 |
| 1,258,304 | 3/1918 | Bishop | 339/276 T |
| 2,480,280 | 8/1949 | Bergan | 339/276 T |
| 2,806,215 | 9/1957 | Redslob | 339/276 T |

FOREIGN PATENTS OR APPLICATIONS

| | | | |
|---|---|---|---|
| 225,262 | 1/1963 | Austria | 339/276 T |

*Primary Examiner*—Roy Lake
*Assistant Examiner*—Mark S. Bicks
*Attorney, Agent, or Firm*—Harold J. Rathbun; Carmen B. Patti

[57] ABSTRACT

A terminal connector or lug for use as a termination for electrical cables is formed by an impacting process. The connector comprises an apertured mounting pad portion and an integral cylindrical tubular body portion having an open end and a closed end and adapted to be crimped onto an electrical cable. The pad is of a generally rectangular parallelepiped shape and extends longitudinally outwardly from the closed end of the tubular portion adjacent an outer peripheral region thereof. Opposite side portions of the inner end portion of the pad extend inwardly of the closed end of the tubular portion, and the wall closing the closed end of the tubular portion is of uniform thickness and is perpendicular to an upper surface of the pad. The region of intersection of the tubular portion and the pad provides a transitional section permitting the connector to be as short as possible and minimizing metal waste while presenting a current transfer area of adequate cross section so that the current carrying capacity throughout the length of the connector is sufficiently uniform to prevent any hot spots.

13 Claims, 4 Drawing Figures

ELECTRICAL TERMINAL CONNECTOR

BACKGROUND OF THE INVENTION

This invention relates to electrical terminal connectors or lugs, and more particularly to solderless terminal connectors of the heavy duty type for use with copper or aluminum cables and which are connectable to electrical cables by a crimping process.

Prior terminal connectors which are connectable to cables by a crimping process have been formed by forging or casting processes or by a combined impacting and forging process.

Connectors formed by the forging process have a pad forged at one end of a piece of tubular stock. A draft or slope results at the transitional section between the tubular portion and the pad and a tapered cavity exists within the transitional section. Because a sealing compound is generally put into the opening in tubular portion before inserting a cable, the tapered cavity requires that an additional and wasted amount of sealing compound be added to fill this dead volume in order to insure that the compound will make adequate contact with the cable.

Prior connectors formed by casting or by the combined impacting and forging process also have a draft or slope at the transitional section between the body portion and the pad. The draft is required in the cast connectors to permit the pattern to be withdrawn from the mold. Although the draft at the transitional section may be eliminated in a cast connector, a draft will then be required at other ninety degree corners, such as on the pad. In the combined impacting and forging process, a tubular body portion is first impacted out of one end of a length of solid cylindrical stock. A pad is then forged at the other end. The transitional section between the body portion and the pad necessarily has a relatively large draft or slope in order to prevent deformation of the tubular portion or shearing at the closed end of the tubular portion during the forging of the pad. Unlike the forged connectors made from tubular stock, cast or impacted and forged connectors have a solid metal transitional section.

The terminal connectors of the crimp type formed by the above processes are longer than necessary from an electrical standpoint because of the sloping transitional section between the tubular portion and the pad. The sloping configuration of the transitional section is not electrically functional and adds considerable undesired length to the connector. This additional length renders such terminal connectors difficult to install in applications having limited space and unsuitable for use in industrial control equipment designed for the use of terminal connectors in which the cables are clamped by means of one or more screws. Furthermore, the existing connectors have a surplus of metal at the transitional section.

A need exists for an electrical terminal connector of the crimp type having a transitional section between the pad and the tubular portion that adds no length to the connector, which includes no wasted metal, and which still has adequate current carrying capacity throughout its length.

SUMMARY OF THE INVENTION

An improved electrical connector in accordance with this invention has a generally cylindrical tubular body portion having one end closed by a wall of uniform thickness which is perpendicular to the longitudinal axis of the body. An apertured pad of generally rectangular parallelepiped configuration extends outwardly from, and in a perpendicular relationship to, the end wall of the tubular portion in a direction generally parallel to the longitudinal axis of the tubular portion and adjacent a peripheral region of the tubular portion. An inner end portion of the pad in effect is positioned a short distance toward the open end of the tubular portion from the closed end thereby to provide a volume of metal at the region of intersection of the pad and tubular portion to provide the desired current carrying capacity thereby preventing the formation of any hot spots.

An object of this invention is to provide an improved electrical connector capable of being connected to an electrical cable by a crimping process and having a transitional section between a mounting pad portion and a cylindrical tubular body portion of minimal length but of sufficient current transfer area for the desired current carrying capacity of the connector.

A further object is to provide such a connector which permits contact of the pad with a mounting surface without interference from the body portion which is deformed during the crimping process.

A further object is to provide such a connector in which an upper surface of the pad is normal to a rear wall of the connector.

BRIEF DESCRIPTION OF THE DRAWINGS

Other objects and advantages of the invention will become apparent from the following description of a preferred embodiment wherein reference is made to the accompanying drawings in which.

DESCRIPTION OF THE PREFERRED EMBODIMENT

Figure 1:
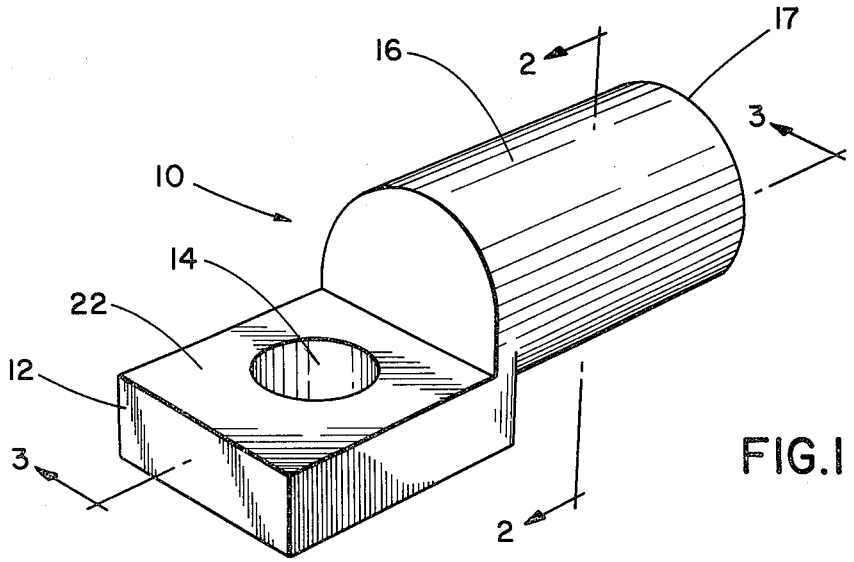
FIG. 1 is a perspective view of an electrical terminal connector in accordance with this invention.

Referring to the drawing, an improved connector in accordance with the invention is identified generally at 10 and comprises a pad portion 12 provided with a centrally located aperture 14 for receiving a holding bolt or similar securing device (not shown), and a cylindrical body portion 16 integral with the pad 12 and having an axial cylindrical bore 18 for receiving an unsheathed end portion of a multi-stranded electrical conductor or cable (not shown). The bore 18 extends inwardly of the body 16 from an open end 17 nearly to an end wall 20 of uniform thickness which is perpendicular to the longitudinal axis of the body 16 and to a flat upper surface 22 of the pad 12. The wall 20 is preferably at least as thick as the cylindrical wall of the body 16 in order to provide adequate mechanical strength and current transfer area at the intersection of the inner end portion 28 of the pad 12 and the cylindrical wall of the body 16.

Crimping of the connector which secures the connector to the electrical conductor or cable may be accomplished by the tool shown in McDurmont U.S. Pat. No. 3,230,713 issued Jan. 25, 1966, or a similar device. The pad 12 and body 16 are preferably aluminum; however, they may be made of other metals such as copper.

The pad 12 has a generally rectangular parallelepiped shape, although a pad having one or more rounded edges or corners may be used. The pad 12 extends outwardly away from the body 16 from the closed end wall 20 of the body 16 in a direction generally parallel to the longitudinal axis of the body 16. The upper surface 22 of the pad 12 is disposed below the longitudinal axis of the axial bore 18 and a lower surface 24 of the pad 12 is disposed a short distance below an outer peripheral surface of the body 16 so that when the body 16 is deformed during the crimping process an expanded outer surface portion of the body 16 will not interfere with the contact of the lower surface 24 of the pad 12 with a flat termination surface (not shown) on which the pad is mounted.

An inner end portion 28 of the pad 12 has an end face 30 which is disposed toward the open end of the body 16 from the outer surface 32 of the end wall 20 so as to be substantially coplanar with an inner surface 34 of the end wall 20. The end face 30 is generally rectangular with its upper side concave.

The current transfer region at the intersection of the inner end portion 28 of the pad 12 with the closed end portion of the body 16 has adequate ampacity yet minimizes the overall length of the connector and reduces metal waste.

Figure 2:
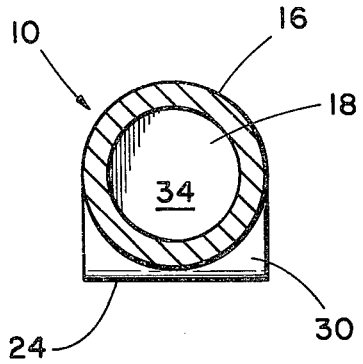
FIGS. 2 and 3 are sectional views taken generally along the lines 2—2 and 3—3, respectively, of FIG. 1.
Figure 3:
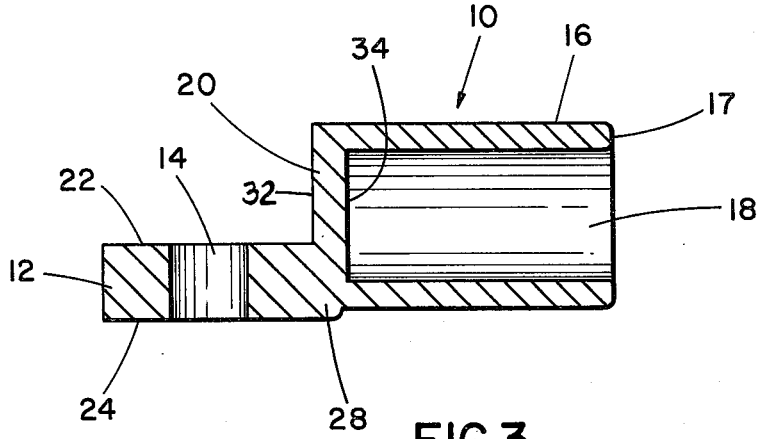
Figure 4:
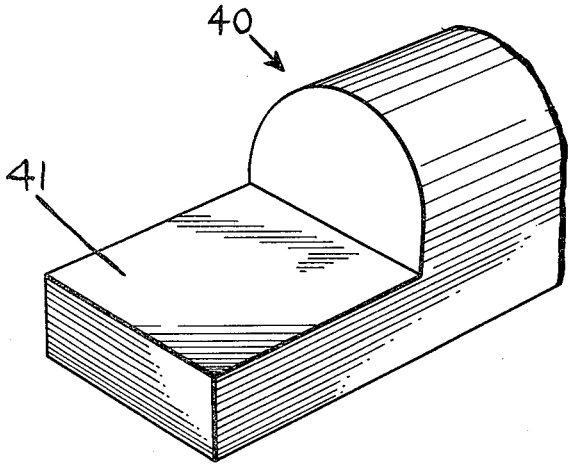
FIG. 4 is a perspective view of a slug from which the finished electrical connector of FIG. 1 is formed by an impacting process.

The connector 10 shown in FIGS. 1–3 may be formed by an impacting process from a slug 40 shown in FIG. 4. The slug 40 has a pad 41 formed from an extrusion by a forging process. The impacting process is described in *Aluminum Impacts: A Design Manual*, which was published in January, 1970, by the Aluminum Association, 750 Third Avenue, New York, N.Y., 10017. The volume of the slug must have the volume of metal required to form the desired body portion with a possible allowance for metal overflow, which may occur during the impacting process. After the pad 20 and body portion 16 are formed, the aperture 14 is drilled or punched.

Thus it is apparent that there has been provided, in accordance with the invention, an electrical terminal connector that fully satisfied the objects, aims, and advantages set forth above. While the invention has been described in conjunction with a specific embodiment, it is evident that many alternatives, modifications, and variations will be apparent to those skilled in the art in light of the aforegoing description. Accordingly, it is intended to embrace all such alternatives, modifications, and variations as fall within the spirit and scope of the appended claims.

We claim:

1. A terminal connector for use as a termination for electrical cables and formable by an impacting process, the connector comprising a generally cylindrical tubular body portion having a longitudinal axis, one end closed by an end wall having a flat outer face, and an opening extending along the longitudinal axis inwardly from the other end for receiving an unsheathed end of a cable and terminating to define a flat inner face of the end wall parallel to and closely spaced from the outer face, a pad extending outwardly from the closed end of the body portion and having an upper surface and a lower surface, the upper surface being disposed between a lower peripheral edge and the longitudinal axis of the body portion, an inner end face of the pad being disposed only between the upper surface and the lower surface and toward the open end of the body portion from the closed end and substantially coplanar with the inner face of the closed end wall thereby to provide a terminal connector that has a minimum overall length, a body portion fully accessible for crimping, and a transitional section having a desired current carrying capacity with minimal metal waste.

2. A terminal connector as claimed in claim 1 wherein the lower surface is disposed a relatively short distance below the lower peripheral edge of the body portion.

3. A terminal connector as claimed in claim 1 wherein the closed end is perpendicular to the longitudinal axis of the body.

4. A terminal connector as claimed in claim 1 wherein the pad has a generally rectangular parallelepiped shape.

5. A terminal connector as claimed in claim 1 wherein the pad is generally parallel to the longitudinal axis of the body.

6. A terminal connector as in claim 1 wherein the inner end face is a four sided configuration having a pair of opposed narrow sides and a pair of opposed wider sides, one of the wider sides being concave toward the opposed other wider side, the other wider side being disposed along the lower surface.

7. A terminal connector for use as a termination for electrical cables and formable by an impacting process, the connector comprising a generally cylindrical tubular body portion having one end closed by an end wall perpendicular to the longitudinal axis of the body and an axial opening extending inwardly from the other end for receiving an unsheathed end of a cable, and a pad having a generally rectangular parallelepiped shape, extending generally parallel to the longitudinal axis of the body portion outwardly from the closed end of the body portion, and having an upper surface and a lower surface, the lower surface being disposed a relatively short distance belo the lower peripheral edge of the body portion and the upper surface being disposed between said lower peripheral edge and the longitudinal axis of the body portion, an inner end face of the pad being disposed toward the open end of the body portion from the closed end and substantially coplanar with an inner face of the closed end wall thereby to provide a terminal connector that has minimum overall length, a body portion fully accessible for crimping and a transitional section having a desired current carrying capacity with minimal metal waste.

8. A terminal connector for use as a termination for electrical cables, comprising a generally cylindrical tubular body portion having a continuously solid cylindrical wall bounding a sealant retaining cavity open at a first end to receive an electrical cable therein, an end wall integrally formed with said cylindrical wall at a second end thereof to sealingly close said second end of said cylindrical tubular body portion, said integrally formed cylindrical wall and end wall being of substantially the same uniform thickness throughout, a terminal pad portion for connection to another electrical conductor, said terminal pad having a transitional end region integrally formed with said end wall and said cylindrical wall, said transitional end region of said terminal pad being of substantially the same uniform thickness as said cylindrical and end walls throughout the region of integral connection therewith to provide a continuously uniform current path of pre-selected uniform thickness and chosen current carrying capacity to avoid over-heated portions between said cylindrical tubular body portion and said terminal pad portion, said cylindrical tubular body portion extending in one direction from said transitional end region, the body portion of said terminal pad extending in an opposite direction from said transitional end region.

9. A terminal connector as set forth in claim 8, wherein said end wall is substantially normal to said cylindrical wall.

10. A terminal connector as set forth in claim 8, wherein said terminal pad includes at least one planar surface formed thereon for electrical connection to a conductor, said planar surface lying in a plane spaced from the exterior of said cylindrical wall to space said cylindrical tubular body portion from the surface of a conductor to which said terminal pad is connected.

11. A terminal connector as set forth in claim 8, wherein said terminal pad portion has a substantially rectangular parallelepiped shape, including an upper surface and a lower surface, said upper surface being disposed between an extension of the longitudinal axis of said cylindrical tubular body portion and an outer edge portion of said cylindrical wall at said second end thereof, said lower surface being disposed in a plane lying radially outward from said outer edge portion, an inner end face of said terminal pad facing the direction toward said first open end of said cavity and extending radially outwardly between said outer edge portion of said cylindrical wall and said plane of said lower surface of said terminal pad from a point inwardly of said second end of said cylindrical tubular body portion a distance substantially equal to said uniform thickness of said end wall thereof, the portion of said terminal pad between said second end of said cylindrical tubular body portion and said inner end face and lying adjacent said cylindrical tubular body portion comprising said integral transitional end region of said terminal pad.

12. A terminal connector as set forth in claim 10, wherein said planar surface of said terminal pad lies in a plane substantially parallel to said cylindrical tubular body portion.

13. A terminal connector as set forth in claim 8, wherein the width of said terminal pad portion is no greater than the diameter of said cylindrical tubular body portion to provide a terminal connector compact in width as well as in length.

* * * * *